United States Patent [19]

Paschkis

[11] 3,989,917

[45] Nov. 2, 1976

[54] THERMAL PRINTING HEAD

[75] Inventor: Albert Ernst Paschkis, Gwynedd Valley, Pa.

[73] Assignee: Leeds & Northrup Company, North Wales, Pa.

[22] Filed: Oct. 1, 1975

[21] Appl. No.: 618,661

[52] U.S. Cl. ..... 219/216; 219/543; 338/308; 338/309; 346/76 R

[51] Int. Cl.[2] ..... H05B 1/00

[58] Field of Search ..... 219/216, 543; 338/306–309; 346/76 R; 427/58; 40/28; 29/610, 611

[56] References Cited

UNITED STATES PATENTS

| | | | |
|---|---|---|---|
| 3,764,429 | 10/1973 | Janning | 427/123 X |
| 3,870,856 | 3/1975 | Taniguchi | 219/216 |

*Primary Examiner*—C. L. Albritton
*Attorney, Agent, or Firm*—William G. Miller, Jr.; Raymond F. MacKay

[57] ABSTRACT

A thermal print head produced by a multilayer process is disclosed. Six of the seven bar-segments of the figure "8" produced by resistive deposits are bounded on the outside by conductive deposits and on the inside by the internal areas of the figure "8" while the seventh is bounded by the internal areas of the figure "8". The peripheral segments are heated selectively by conduction between selected bar-segments and associated internal areas at a particular time while the internal areas are energized to heat the central segment at another time. Each internal area has a single electrical connection to the external switching circuitry.

3 Claims, 2 Drawing Figures

THERMAL PRINTING HEAD

BACKGROUND OF THE INVENTION

This invention relates to a printing head for use in thermal printing particularly in the thermal printing of Arabic numerals on heat sensitive paper. More particularly this invention relates to a thermal print head construction which makes possible the printing of very small numerals.

In the construction of the thick film type seven bar-segment thermal print heads the possible size reduction which may be accomplished is limited to about 0.125 inches in order to provide for the necessary connections to the central areas of the seven segment figure "8" type of numeral layout. Normally the connections to the central areas of a seven segment figure "8" are made by using the multi-layer technique, that is by laying down alternate layers of printed conductors with overlaying layers of insulating material such as glass. These layers are laid down by screening techniques as required to make the necessary connections. Of course the conductors printed on one layer require holes (called "vias") in the glass laid down in the next layer to connect the conductors to conductive areas in the top layer. Those holes are of course filled with conductive material as additional layers are printed. The number of holes required for connection to a particular central area of a seven bar-segment figure "8" limits the size reduction possible for the figure. Previous thermal print heads have always required at least two connections to a central area of the figure "8" configuration and therefore the structure of the present invention allows for a reduction in size previously unattainable. Previously the overall height of the numeral could not be reduced to less than approximately 0.125 inches whereas with the present invention numerals are readily obtainable with a height of 0.084 inches.

SUMMARY OF THE INVENTION

In accordance with this invention there is provided a thermal print head which comprises seven separate resistive heating segments. Six of the segments are arranged as peripheral segments of the figure "8" with the seventh segment forming the central segment of that figure. A separate electrical conductive segment defines the outside boundary of each of the peripheral segments and a means is provided to electrically connect each of those conductive segments to external circuitry. Two spaced electrically conductive areas representing the internal areas of the figure "8" are provided to define the inside boundaries of associated peripheral segments while the areas themselves define the boundaries of the central segment. The print head includes means providing a single electrical connection only to each of the two spaced conductive areas to thereby allow a minimization of the size of the thermal print head and hence the size of the numeral which can be printed.

DESCRIPTION OF THE PREFERRED EMBODIMENTS

Figure 1:
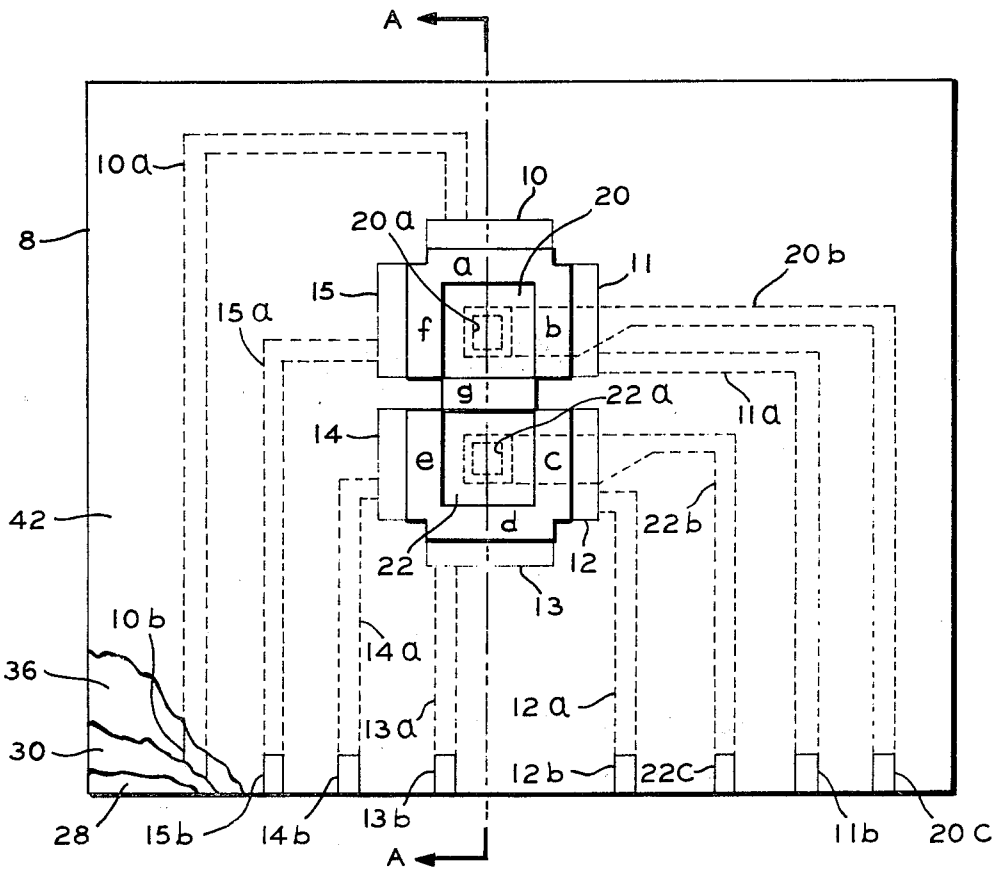
FIG. 1 is a plan view of a seven segment figure "8" print head from the side which contacts the paper on which printing is done. The associated electrical connections as required to print a single numeral are also shown.

In FIG. 1 the thermal print head 8 is shown as having six resistive heating segments *a*, *b*, *c*, *d*, *e* and *f* which are peripheral segments of the figure "8" and a central resistive heating segment *g*. All of these segments are arranged to contact the heat sensitive paper on which the numeral is to be printed. Separate electrical conductive segments 10–15 define the outside boundary of each of the peripheral segments a–f, respectively, as shown in FIG. 1. Each of those conductive segments is provided with an electrical connection to a terminal on the print head 8. For example, the conductive segments 10, 11, 12, 13, 14 and 15 are connected by printed conductors 10*a*, 11*a*, 12*a*, 13*a*, 14*a* and 15*a*, respectively, to their associated corresponding terminals 10*b*, 11*b*, 12*b*, 13*b*, 14*b* and 15*b* along the edge of print head 8 for convenient connection of the print head 8 with the external switching circuitry necessary for operation of the print head.

The seventh resistive segment *g* of the figure "8" which forms the central segment of the figure has its side boundaries defined by the two respective central areas of the figure, namely areas 20 and 22. The area 20 is provided with an electrical connection by way of the conductive material which is deposited in the single hole, shown as 20*a*, which connects by way of the printed conductor 20*b* to the terminal 20*c*. Similarly the central area 22 connects by way of the conductive material deposited in hole 22*a* and the conductor 22*b* to the terminal 22*c*.

Figure 2:
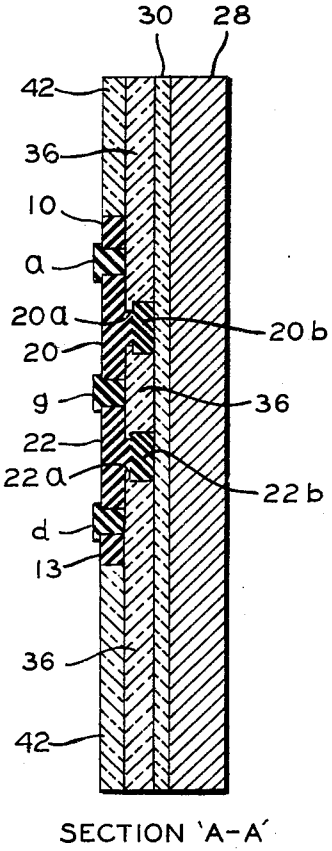
FIG. 2 shows a cross section of the thermal print head of FIG. 1 taken at A—A.

The thermal print head 8 is constructed by a multilayer technique which includes a heat sink 28 in conjunction with the other layers shown in FIG. 2 as the section A—A of FIG. 1.

The heat sink 28 serves as a means for dissipating heat from the print head as rapidly as possible so that once a numeral is printed the print head may be energized soon thereafter for the printing of another numeral. The heat sink 28 is also used as a support for the ceramic base 30 of the print head. The ceramic base may be thin and is used as a base upon which to print a first group of conductors such as the conductors 20*b* and 22*b*. The conductors 20*b* and 22*b* will have two closely spaced terminal ends under the areas 20 and 22.

An insulating layer of glass is laid down in the areas 36 around the holes 20*a* and 22*a*.

By using appropriate screens the printed conductors and conducting layers mentioned above may be laid down on the ceramic base 30 and likewise the insulating layer such as glass may also be appropriately laid down to cover those areas which are intended to be nonconductive. Over top of these layers there may be laid other layers which will include the six separate conducting areas 10–15 which may be laid down using one screen which screen will also include appropriate open areas for the printing of the conductors 10*a*–15*a* to provide for the connections to the terminals 10*b*–15*b*, respectively. The central areas 20 and 22 are also printed as conductive areas at the same time that the peripheral segments 10–15 and the associated leads 10*a*–15*a* are printed. It will be evident from FIG. 2 that the printed conductive areas 20 and 22 then make conductive contact with the conductors 20*b* and 22*b* through holes 20*a* and 22*a* as shown in FIG. 2.

The next layer laid down is a glass area 42 which covers all of the print head 8 with the exception of the areas which are printed as conductive areas 10–15, 20 and 22 and conductors 10*a*–15*a* as well as the areas *a*, *b*, *c*, *d*, *e*, *f* and *g* which are laid down as film resistors deposited between the associated peripheral segments 10–15 and areas 20 and 22. The resistive heating segments *a–g* are deposited so as to overlap the conductive segments 10–15 and the area 20 and 22 as shown in FIG. 2. The overlapping portion will normally not be an area which will print since it will not carry sufficient current to offset the heat sensitive recording paper.

It will be evident that in the printing of different numerals with the print head described above it will be necessary to selectively apply a potential difference between the selected ones of the conductive segments 10–15 and the internal areas 20 and 22 at a certain time in order to heat up the film resistors *a*, *b*, *c*, *d*, *e* or *f* as required for printing the peripheral segments of the numeral desired on the heat sensitive paper with which the print head will be in contact. It will then be necessary at a later time to apply a potential difference between the conductive central areas 20 and 22 whenever it is desired to heat up the film resistor *g* to print a central segment of the figure "8" configuration of the numeral being printed so requires. Thus, the external circuitry for the operation of the printing head 8 requires that one of the central areas 20 or 22 should be reversed in polarity between the times when the peripheral segments are printed and the time when the central segment is printed, thus the external circuitry for printing with the print head 8 differs from the type of circuitry normally utilized in the operation of seven bar-segment thermal print heads constructed in accordance with the prior art.

What is claimed is:

1. A thermal print head comprising seven separate resistive heating segments, six of said segments being arranged as peripheral segments of a figure "8" with the seventh segment forming the central segment of said figure, a separate electrical conductive segment defining the outside boundary of each of said peripheral segments, means providing an electrical connection to each of said separate conductors, two spaced electrically conductive areas representing the internal areas of the figure "8", each of said areas defining the inside boundaries of associated peripheral segments with both of said areas jointly defining the boundaries of said central segment, and means providing a single electrical connection only to each of said two spaced conductive areas.

2. A thermal print head comprising an insulating layer supported on a base member, six separate conducting areas printed on said insulating layer so as to form the outer boundary for six separate segments of the outer periphery of a seven segment figure "8", two separate conducting areas printed on said insulating layer to form the internal central areas of said figure "8", film resistors deposited between said peripheral segments and said central areas and between said central areas to form by said film resistors both peripheral segments and a central segment of a seven segment representation of the figure "8", and conductors for connecting said peripheral conducting areas to external circuitry so that the selective application of potential differences between the selected ones of the conductive segments and the conductive central areas will simultaneously heat up the film resistors forming particular selected peripheral segments of said figure "8", and a single conductor only for connecting each of said conductive central areas to external circuitry so that selective application of a potential difference between said central areas heats up the film resistor forming the central segment of said figure "8" to print said central segment.

3. A thermal print head comprising an insulating base member, two printed conductors overlaying said base for providing electrical connection of two closely spaced terminal ends of said conductors on said base to external circuits, an insulating layer covering said conductors except for said terminal ends, six separate conducting areas printed on said last named insulating layer so as to form the outer boundary for the six separate segments of the outer periphery of a seven segment figure "8", two separate conducting areas printed on said last named insulating layer to form the internal central areas of said figure "8" over and in electrical contact with said terminal ends, film resistors deposited between said peripheral segments and said central areas and between said central areas to form by said film resistors both peripheral segments and a central segment of a seven segment representation of the figure "8", and printed conductors connecting said peripheral conducting areas to external circuitry so that the selective application of potential differences between the selected ones of the conductive segments and the conductive central areas simultaneously heat up the film resistors forming particular selected peripheral segments of said figure "8" at a certain time and application of a potential difference between said conductive central areas heats up the film resistor forming the central segment of said figure "8" at another time when the numeral to be printed requires said central segment.

* * * * *